United States Patent [19]

Moser

[11] 4,302,968

[45] Dec. 1, 1981

[54] METHOD AND APPARATUS FOR MEASURING THE LINEAR DENSITY OF A TRAVELLING FIBER SLIVER

[75] Inventor: Robert Moser, Winterthur, Switzerland

[73] Assignee: Rieter Machine Works, Ltd., Winterthur, Switzerland

[21] Appl. No.: 84,894

[22] Filed: Oct. 15, 1979

[51] Int. Cl.[3] ..... G01B 13/04; D01H 5/52

[52] U.S. Cl. ..... 73/160; 19/239; 28/250; 73/37.7

[58] Field of Search ..... 73/160, 37.7; 19/239, 19/240, 288; 28/265, 250, 273

[56] References Cited

U.S. PATENT DOCUMENTS

| | | | |
|---|---|---|---|
| 3,435,673 | 4/1969 | Felix | 19/239 X |
| 3,593,566 | 7/1971 | Loopuyt | 73/37.7 |
| 3,710,421 | 1/1973 | Tooka | 73/37.7 X |
| 4,045,659 | 8/1977 | Akagawa et al. | 73/160 |
| 4,051,722 | 10/1977 | Feller | 73/160 |
| 4,074,573 | 2/1978 | Nordhofen | 73/861.52 |
| 4,184,361 | 1/1980 | Erben | 73/160 |
| 4,213,056 | 7/1980 | Matsumura et al. | 73/160 |

*Primary Examiner*—Daniel M. Yasich

*Attorney, Agent, or Firm*—Kenyon & Kenyon

[57] ABSTRACT

The method is used for producing measuring values depending on the linear density of a fiber sliver transported through a measuring funnel. A measuring signal transmitted from the measuring funnel is transformed into a proportional electric voltage signal and is continually integrated. The apparatus comprises a measuring funnel connected pneumatically with a pneumatic/electric transducer which transmits a signal to an integration circuit means. A control logic which cooperates with a gear of the transmission of the spinning preparatory machine is connected with the integrating circuit means via a proximity initiator which transmits an impulse to the control logic at each passage of a tooth. The integrating circuit means supplies measuring values suitable as a control signal for spinning preparatory machines, which signal is independent of the speed of the fiber sliver.

15 Claims, 3 Drawing Figures

Figure 1:
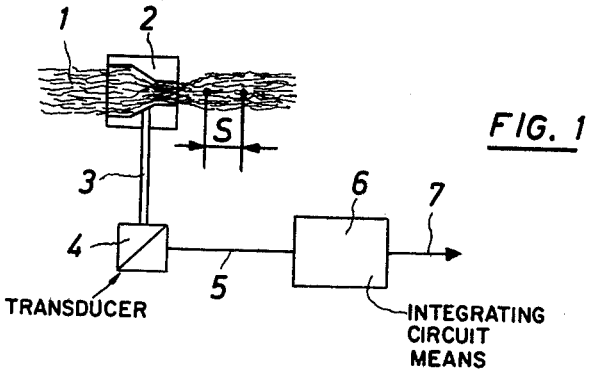

1
2
8
8
S
10
TRANSMISSION
9
MOTOR
3
t
11
PROXIMITY
INITIATOR
12
18
CONTROL
MEANS
4
CONTROL
LOGIC
MEANS
13
TRANSDUCER
5
6
14
INTEGRATING
CIRCUIT
MEANS
16
15
17
7

METHOD AND APPARATUS FOR MEASURING THE LINEAR DENSITY OF A TRAVELLING FIBER SLIVER

This invention relates to a method and apparatus for producing measuring values corresponding to a linear density of a travelling fiber sliver. More particularly, this invention relates to a method and apparatus of producing measuring values corresponding to the linear density (titre) of fiber slivers produced in spinning preparation.

As is known, in order to maintain quality control in spinning preparation, a suitable measuring method for measuring the linear density of a travelling fiber sliver is of decisive importance. In this respect, the measurement is used for the control and correction of the production processes on the base of these measuring values. For example, as described in Swiss Pat. No. 436,779, it has been known to use a measuring method wherein a fiber sliver is transported at operating speed through a measuring funnel in order to establish a pressure measuring signal depending on the linear density. However, in this case, a disadvantage arises since the measuring values produced depend on the speed of the travelling fiber sliver. Although this dependence is noticed, no satisfactory means has been proposed for eliminating this dependence. For example, with reference to FIG. 5 of the Swiss patent, an arrangement is described which contains an air compressing device which is driven at a rotational speed proportional to the throughput speed of the fiber sliver. If the pressure generated in the compressing device is opposed to the pressure generated in the measuring funnel, the relation between the pressure in the measuring funnel, or in one leg of a manometer, and the pressure in the other leg of the manometer is supposedly the sole measure of the linear density of the fiber sliver. However, as the pressure signal generated in the measuring funnel corresponding to the linear density of the fiber sliver also depends proportionally on the fiber sliver speed, the compensation brought about by the air compressing device which is driven at a rotational speed proportional to the fiber sliver speed results in an over-compensation. As the pressure generated by the air compressing device depends on the square of the rotational speed thereof, the measuring values obtained are still influenced by the fiber sliver throughput speed.

Accordingly, it is an object of the invention to produce measuring values corresponding to the linear density of a travelling fiber sliver which are independent of the throughput speed of the fiber sliver.

It is another object of the invention to be able to easily adjust the throughput speed of a fiber sliver or textile material in order to insure a constant linear density of the sliver or material.

Briefly, the invention provides both a method and an apparatus for producing measuring values corresponding to a linear density of a travelling textile material such as a fiber sliver.

The method is intended to produce a signal representing a characteristic of a textile material flowing past a sensor which is responsive to the speed of flow of the material as well as to the characteristic. In this case, an output signal from the sensor is integrated to produce an integrated signal representative of the characteristic but substantially independent of the speed of flow of the material. In accordance with the method, the output singal is repeatadly integrated over an interval representing a predetermined length of material flowing past the sensor.

In one embodiment, the method resides in the steps of transporting a textile material such as a fiber sliver at an operating speed through a measuring funnel, of obtaining a pressure measuring signal depending on the linear density of the fiber sliver from a given point in the funnel, of transforming the obtained signal into a proportional voltage signal, and of continuously integrating the proportional voltage signal over a time period required for the fiber sliver to travel over a path corresponding to a length of a given distance (i.e. a determinable length) to produce an integration value as a measure of the linear density of the fiber sliver. In accordance with the method, each integration value is stored until a following integration value is received. At this time, the stored integration value is cancelled.

In accordance with this method, the pressure measuring signal is transduced into a proportional voltage signal which is continually integrated over a time period which the fiber sliver requires for covering a path corresponding to the length of a measuring distance which is maintained constant for each integrating step.

The apparatus comprises a sensor which is responsive not only to a predetermined characteristic of the textile material but also to the speed of flow of the material as well as an integrator which is operable to integrate an output signal from the sensor in order to produce an integrated signal representative of the characteristic but substantially independent of the speed of flow of the material.

In one embodiment, the apparatus comprises a pneumatic measuring funnel for passage of a travelling textile material of varying linear density, such as a fiber sliver therethrough, a pneumatic/electric transducer pneumatically connected to the funnel to measure the pressure therein during travel of a fiber sliver therethrough and to emit an electrical signal corresponding to a measured pressure and an integrating circuit means electrically connected to the transducer to receive and integrate the electrical signal. In addition, the apparatus includes a pair of rolls for moving the fiber sliver through the funnel, a transmission for driving the rolls which includes the rotatable gear, a proximity initiator adjacent to the gear and a control logic means connected to and between the proximity initiator and the integrating circuit means. The proximity initiator serves to pick-off predetermined increments of motion of the gear corresponding to a given length of travel of the fiber sliver and to emit an impulse corresponding thereto. The control logic means receives each impulse from the initiator and controls the integrating circuit means whereby the electrical signal received from the transducer is integrated over a given period of time corresponding to a received impulse.

It is advantageous if the integration value is stored until a subsequent integration value arrives and to clear the stored integration value as the subsequent integration value is taken over while maintaining the measuring distance constant. To this end, the integrating circuit means is also constructed as a sample and hold circuit means. In this case, the circuit includes a collecting condensor for integrating a received electrical signal thereon and a hold condensor for storing an integrated electrical signal thereon. The proximity initiator can be constructed in such a manner that at each passage of a tooth of the gear, an impulse is transmitted to the control logic means. In addition, the control logic means may control the condensors via suitable switches so that between a first and second impulse, an integration value is formed at the collecting condensor by an integration of the received electrical signal and, between a second and a third impulse, the integrated value or signal is stored on the hold condensor.

It is of further advantage if the integrating circuit means includes an output circuit which is connected to the hold condenser to receive and emit a stored signal thereon as an output signal which can be used, for example for controlling the transmission for driving the rolls. In this regard, the apparatus can be particularly used in a spinning preparatory machine.

Figure 2:
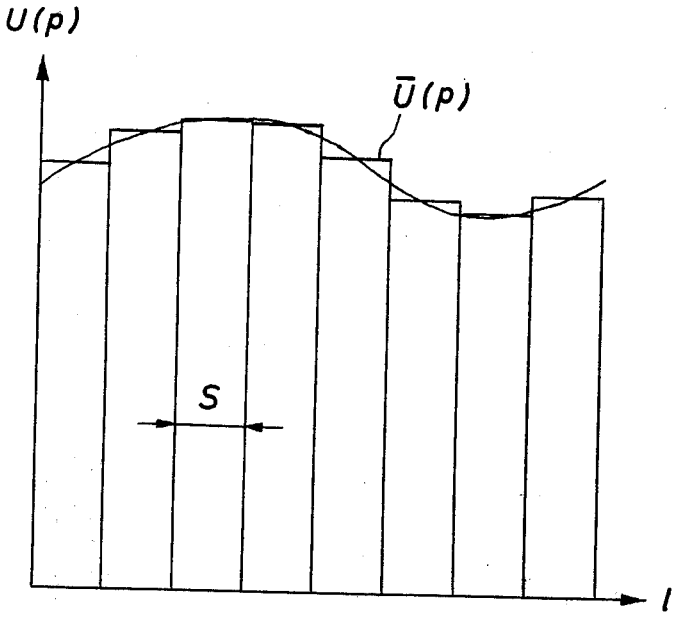
Figure 3:
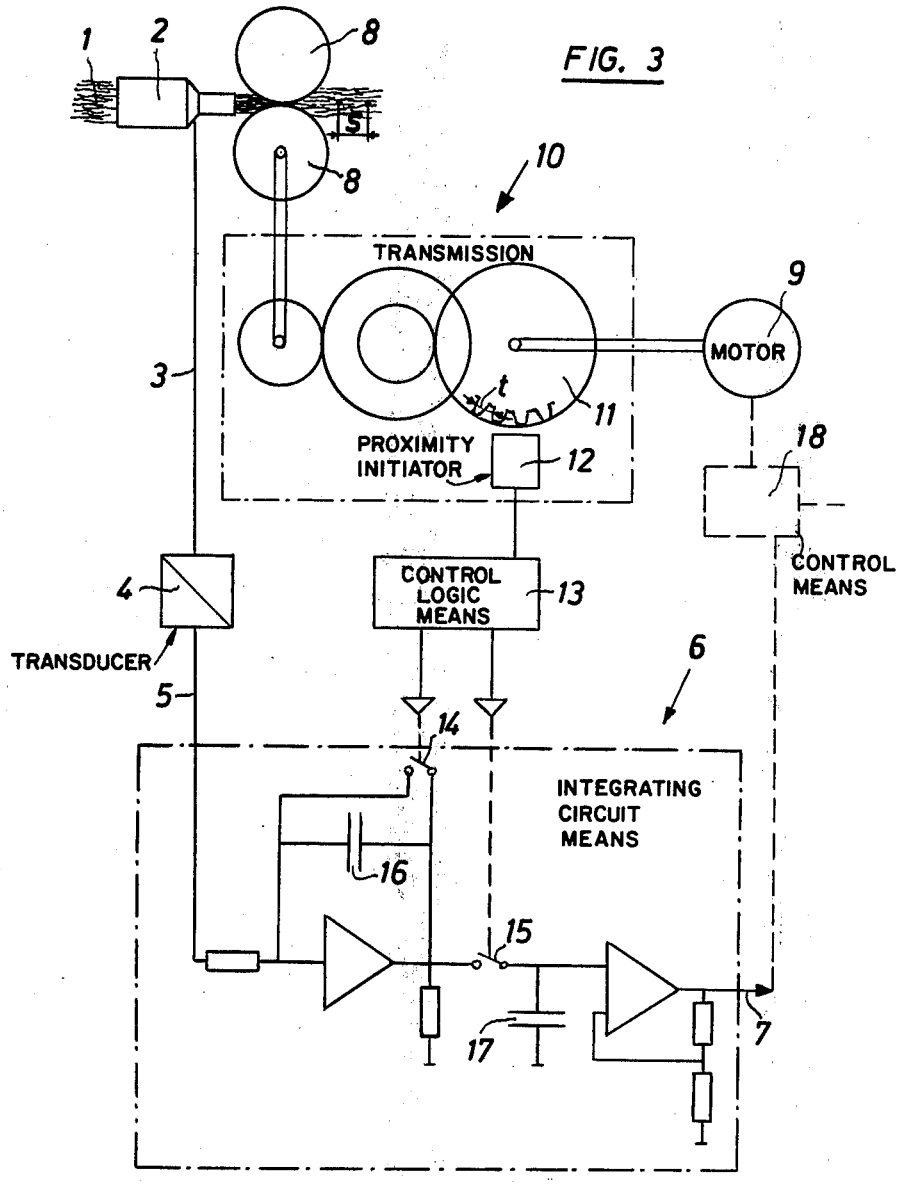

These and other objects and advantages of the invention will become more apparent from the following detailed description and appended claims taken in conjunction with the accompanying drawings in which:

FIG. 1 schematically illustrates an apparatus according to the invention;

FIG. 2 diagrammatically illustrates an example of the course of an electrical voltage signal at the sample and hold condensor; and FIG. 3 schematically illustrates an apparatus of the invention as used on a spinning preparatory machine.

Referring to FIG. 1, an apparatus for measuring the linear density of a fiber sliver 1 includes a measuring funnel 2 through which the sliver is transported at operating speed. A pneumatic duct 3 merges into the funnel 2 at a point of reduction of the cross-sectional area of the funnel 2. This pneumatic duct 3 serves to measure the pressure in the measuring funnel 2 in a known manner as a measure of the linear density of the fiber sliver. The measured pressure is emitted in the form of a pneumatic measuring output signal which is transmitted from the duct 3 to a pneumatic/electric transducer 4. The transducer 4 transforms the pressure into an electrical signal in the form of a proportional voltage signal. This signal is then transmitted via a line 5 to an integrating circuit means 6 in which the voltage signal is integrated. In this process, an integration end value of the voltage is continuously formed over a time period which the fiber sliver requires for covering a distance chosen as a constant measuring length s. The integration value which corresponds to an output signal 7 is held in storage until cancelled upon arrival of the next integration value. The output signal 7 thus forms a measure for the linear density (titre) of a constant length of the fiber sliver. This measure is well suited for control purposes or, by suitable transformation, can be transduced into a normal measured value of linear density.

Referring to FIG. 2, the course of the voltage U (p) depending on the pneumatic pressure is plotted (toward the right hand side) against the length l covered by the fiber sliver (extending upward, as viewed). The integration value $\overline{U}$ (p) corresponding to the output signal 7 forms a step line, the step width s of which corresponds to the measuring length of the fiber sliver. The integration value $\overline{U}$ (p) thus forms the mean value of the voltage U (p) over the integration interval, and comes closer to coinciding with the momentaneous voltage course, the shorter the measuring length s is chosen. The output signal 7 forming a measure of the linear density of the fiber sliver is thus entirely independent of the fiber sliver speed, as the integration value is formed always over the same constant length of sliver. The integration time and the pressure (p) change in opposite senses, if the fiber sliver speed changes just as the fiber sliver covers the path corresponding to the measuring length s faster or slower.

Referring to FIG. 3, wherein like reference characters indicate like parts as above, the above apparatus can be utilized in a spinning preparatory machine. To this end, a pair of rolls 8 of the spinning preparatory machine (not shown in detail) serve to move the fiber sliver 1 through the funnel 2. In addition, a transmission 10 is provided for driving the rolls 8, which transmission 10 includes a rotatable gear 11 having a plurality of peripheral teeth spaced apart at a given pitch t. The transmission 10 is, in turn, driven by a motor 9 of suitable construction.

As shown in FIG. 3, the pneumatic measuring funnel 2 is connected to a pneumatic/electric transducer 4 via a pneumatic duct 3. The transducer serves to measure the pressure in the funnel during travel of the fiber sliver 1 therethrough and to emit an electric signal in the form of a proportional voltage signal in correspondence to the measured pressure. As above, the transducer 4 is electrically connected via a line 5 to an integrating circuit means which is constructed as an integration and sample and hold circuit means. This integrating circuit means 6 functions to receive and integrate the received the proportional voltage signal in order to yield an output signal 7.

As shown, the circuit means 6 includes a pair of switches 14, 15, a collecting condensor 16 for integrating a received proportional voltage signal and a hold condensor 17 for storing an integrated proportional voltage signal thereon.

In addition, the apparatus includes means for generating a signal defining a series of intervals each of which is of short duration and corresponds to a determinable length of fiber sliver 1 passing the measuring funnel 2. This means is in the form of a proximity initiator 12 adjacent the gear 11 which functions to pick-off predetermined increments of motion of the gear 11 corresponding to the given length of travels of the fiber sliver 1 and to emit an impulse corresponding thereto. A control logic means 13 is connected to and between the proximity initiator 12 and the integrating circuit means 6 in order to receive the impulses from the initiator 12 and to control the integrating circuit means 6 in such a manner that the signals received from the transducer 4 are repeatedly integrated over given periods of time corresponding to received impulses, i.e. over successive short time intervals. The control logic means is connected via suitable lines to the switches 14, 15 as illustrated.

In operation, the pneumatic pressure measured in the measuring funnel 2 is transformed in the transducer 4 into a proportional voltage and is transmitted into the integrating circuit 6. During this time, the proximity initiator scans, for example, the distance t of two neighboring teeth of the gear 11 so that each time a tooth passes the initator 12 an impulse or signal is transmitted to the control logic means 13. It is to be noted that the gear tooth gauge t is constant from tooth to tooth and corresponds to a small length s of the fiber sliver 1 being transported by the rolls 8 through the funnel 2 and, thus, corresponds to a constant measuring length s.

Thereafter, the control logic means 13 opens and closes the switches 14, 15 in such a rhythm that the voltage values received via the line 5 in the circuit 6 are continuously integrated on the collector condensor 16 between a first and a second impulse produced by the initiator 12. Thereafter, the integrated signal is transferred to the hold condensor 17 and stored between the second and a third impulse. Subsequently, the stored signal is cancelled as the next following integration value arrives.

The circuit means 6 also has an output circuit connected to the hold condensor 17 to receive and emit a stored signal as the output signal 7. During operation, this output circuit continuously yields, with each incremental rotational movement of the gear 11 over the gear tooth gauge t, an integrated voltage value which is proportional to the linear density of the measuring length s of the fiber sliver l or of the fiber sliver length transported by this incremental rotational movement of the gear 11.

The output signal 7 forms a suitable control value for spinning preparation which is independent of the processing speed of the fiber sliver 1. Thus, the signal 7 can be transmitted, for example, into a control means 18 connected to the motor 9 in order to control the speed of the motor and thus the transmission 10. In this way, the speed of the transmission 10 and the pair of rolls 8 connected thereto can be controlled as a function of the linear density of the fiber sliver 1.

It is to be noted that the integration is not restricted to the tooth gauge t of the gear 11 as any desired distance, which is of interest, and which corresponds to the constant path length of the fiber sliver l can be used.

What is claimed is:

1. A method of producing a signal representing a given characteristic of a textile material, said method comprising the steps of:

passing a textile material of varying linear density past a sensor responsive to the speed of flow of the material and the given characteristic;

generating a pressure output signal from the sensor in dependence on the speed of flow of the material and the given characteristic;

generating a further electrical signal defining a series of intervals, each interval being of short duration and corresponding to a determinable length of textile material passing the sensor; and integrating said output signal over each successive interval to produce a signal representative of the given characteristic and substantially independent of the speed of flow of the material.

2. A method as set forth in claim 1 wherein said output signal is repeatedly integrated over an interval representing a predetermined constant length of material flowing past said sensor.

3. An apparatus for producing a signal representing a given characteristic of a travelling textile material, said apparatus comprising a sensor responsive to the speed of flow of material and a given characteristic to generate an output signal dependent upon the speed of flow of the material and the given characteristic;

means for generating a further signal defining a series of intervals, each interval being of short duration and corresponding to a determinable length of textile material passing said sensor; and an integrator operable to integrate an output signal from said sensor over each said interval to produce an integrated signal representative of said characteristic but substantially independent of the speed of flow of the material.

4. An apparatus for producing measuring values corresponding to a linear density of a travelling fiber sliver, said apparatus comprising a pneumatic measuring funnel for passage of a travelling fiber sliver therethrough;

a pneumatic/electric transducer pneumatically connected to said funnel to measure the pressure therein during travel of a fiber sliver therethrough and to emit an electrical signal corresponding to a measured pressure;

an integrating circuit means electrically connected to said transducer to receive and integrate said electrical signal;

a pair of rolls for moving the fiber sliver through said funnel;

a transmission for driving said rolls, said transmission including a rotatable gear;

a proximity initiator adjacent said gear to pick-off predetermined increments of motion of said gear corresponding to a given length of travel of the fiber sliver and to emit an impulse corresponding thereto; and a control logic means connected to and between said proximity initiator and said integrating circuit means to receive an impulse from said initiator and to control said integrating circuit means whereby said electrical signal is integrated over a given period of time corresponding to a received impulse.

5. An apparatus as set forth in claim 4 wherein said proximity initiator emits a pulse to said control logic means at each passage of a tooth of said gear thereby.

6. An apparatus as set forth in claim 4 wherein said integrating circuit means is also a sample and hold circuit means.

7. An apparatus as set forth in claim 6 wherein said circuit means includes a collecting condensor for integrating a received electrical signal thereon and a hold condensor for storing an integrated electrical signal thereon.

8. An apparatus as set forth in claim 7 wherein said circuit means further includes a pair of switches, each switch being connected to and between said control logic means and a respective one of said condensors whereby between a first and a second impulse transmitted by said proximity initiator, an electrical signal is integrated on said collecting condensor and between the second and a third impulse the integrated signal is stored on said hold condensor.

9. An apparatus as set forth in claim 7 wherein said circuit means further includes an output circuit connected to said hold condensor to receive and emit a stored signal thereon as an output signal proportional to the linear density of the measured length of a travelling fiber sliver.

10. An apparatus as set forth in claim 9 which further comprises a motor for driving said transmission and a control means connected to said motor and said output circuit to receive said output signal and to control the speed of said motor and said transmission.

11. A method of producing measuring values corresponding to a linear density of a travelling fiber sliver, said method comprising the steps of transporting a fiber sliver at an operating speed through a measuring funnel;

obtaining a pressure measuring signal depending on the linear density of the fiber sliver from a given point in the funnel;

transforming the obtained signal into a proportional voltage signal;

obtaining a further signal defining a series of intervals, each interval being of short duration and corresponding to a determinable length of fiber sliver passing through the measuring funnel; and continuously integrating the proportional voltage signal over each said interval to produce an integration value as a measure of the linear density in the fiber sliver independent of the speed of the fiber sliver.

12. A method as set forth in claim 11 wherein said integration value is stored until a following integration value is received.

13. A method as set forth in claim 12 wherein said stored integration value is cancelled as said following integration value is received.

14. A method as set forth in claim 11 wherein the given distance is maintained constant for each integrating step.

15. A method as set forth in claim 11 wherein each interval corresponds to a constant length of the fiber sliver flowing through the measuring funnel.

* * * * *

UNITED STATES PATENT AND TRADEMARK OFFICE

CERTIFICATE OF CORRECTION

PATENT NO. : 4,302,968

DATED : December 1, 1981

INVENTOR(S) : Robert Moser

It is certified that error appears in the above—identified patent and that said Letters Patent is hereby corrected as shown below:

Column 4, line 39, change "travels" to --travel s --

Signed and Sealed this

*Twenty-third* Day of *March 1982*

[SEAL]

*Attest:*

GERALD J. MOSSINGHOFF

*Attesting Officer*

*Commissioner of Patents and Trademarks*